United States Patent [19]

Roselle et al.

[11] Patent Number: 4,820,196

[45] Date of Patent: Apr. 11, 1989

[54] SEALING OF CONTACT OPENINGS FOR CONFORMALLY COATED CONNECTORS FOR PRINTED CIRCUIT BOARD ASSEMBLIES

[75] Inventors: Paul J. Roselle, Savage, Minn.; Richard T. Benkusky, Dunedin, Fla.

[73] Assignee: Unisys Corporation, Blue Bell, Pa.

[21] Appl. No.: 103,335

[22] Filed: Oct. 1, 1987

[51] Int. Cl.[4] ..... H01R 23/72

[52] U.S. Cl. ..... 439/519; 29/841; 174/76; 439/936

[58] Field of Search ..... 29/841, 856, 858, 883, 29/885; 264/272.11, 272.12, 272.13, 272.18; 439/736, 85, 936, 519; 427/300; 174/76, 77 R

[56] References Cited

U.S. PATENT DOCUMENTS

| | | | |
|---|---|---|---|
| 2,900,277 | 8/1959 | Schmitz et al. | 117/93 |
| 3,233,028 | 2/1966 | Toppari et al. | 264/272.13 |
| 3,243,756 | 3/1966 | Ruete et al. | 339/60 |
| 3,268,653 | 8/1966 | McNutt | 174/68.5 |
| 3,436,604 | 4/1969 | Hyltin et al. | 317/101 |
| 3,491,323 | 1/1970 | Molgard et al. | 337/379 |
| 3,518,610 | 6/1970 | Goodman et al. | 339/17 |
| 3,625,763 | 12/1971 | Melillo | 134/38 |
| 3,660,726 | 5/1972 | Ammon et al. | 317/101 |
| 3,742,597 | 7/1973 | Davis | 29/625 |
| 3,744,128 | 7/1973 | Fisher et al. | 29/883 |
| 3,755,615 | 8/1973 | Paullus et al. | 174/76 |
| 3,757,276 | 9/1973 | Kallus | 339/143 |
| 3,772,637 | 11/1973 | Paullus et al. | 174/76 |
| 3,838,316 | 9/1974 | Brown et al. | 264/272.18 |
| 3,849,186 | 11/1974 | Tachick et al. | 117/201 |
| 4,010,992 | 3/1977 | Crimmins et al. | 339/17 |
| 4,032,214 | 6/1977 | McNearney | 339/218 |
| 4,054,349 | 10/1977 | Wuttke | 339/99 |
| 4,083,902 | 4/1978 | Clyde | 174/76 |
| 4,090,767 | 5/1978 | Tregoning | 339/143 |
| 4,138,604 | 2/1979 | Harmsen et al. | 200/267 |
| 4,188,714 | 2/1980 | Jean | 29/628 |
| 4,216,576 | 8/1980 | Ammon | 29/845 |
| 4,217,024 | 8/1980 | Aldridge et al. | 339/275 |
| 4,230,385 | 10/1980 | Ammon et al. | 339/17 |
| 4,236,779 | 12/1980 | Tang | 339/143 |
| 4,364,172 | 12/1982 | Kelly | 29/858 |
| 4,396,245 | 8/1983 | Lane | 339/38 |
| 4,433,206 | 2/1921 | Lewis | 174/356 |
| 4,457,576 | 7/1984 | Cosmos et al. | 339/143 |
| 4,460,620 | 7/1984 | Deters | 427/58 |
| 4,494,308 | 1/1985 | Schauer | 29/858 |
| 4,497,533 | 2/1985 | Genova et al. | 339/143 |
| 4,508,414 | 4/1985 | Kusui et al. | 339/143 |
| 4,514,029 | 4/1985 | Lax et al. | 339/143 |
| 4,515,861 | 5/1985 | Arup | 428/450 |
| 4,537,458 | 8/1985 | Worth | 339/143 |
| 4,544,227 | 10/1985 | Hirose | 339/143 |
| 4,557,545 | 12/1985 | Ohtsuki et al. | 339/103 |
| 4,597,624 | 7/1986 | Lax et al. | 339/143 |
| 4,607,469 | 8/1986 | Harrison | 264/272.13 |
| 4,619,487 | 10/1986 | Brush | 339/14 |
| 4,645,278 | 2/1987 | Yevak et al. | 339/17 |
| 4,647,133 | 3/1987 | Renken et al. | 339/97 |
| 4,662,700 | 5/1987 | Markham | 339/143 |
| 4,678,260 | 7/1987 | Gallusser et al. | 439/607 |

OTHER PUBLICATIONS

Etzbach, Allan L., "Conformal Coatings: Materials and Trends, Electronic Packaging and Production", Aug. 1974, pp. 75–82.

*Primary Examiner*—Neil Abrams
*Attorney, Agent, or Firm*—Glenn W. Bowen

[57] ABSTRACT

A connector having a housing with a number of cavities that receive connector pins is conformally coated. A thixotropic, curable material is used to seal-off the cavities at the end where the contact tails for the connector pins emerge from the housing. The sealing material seals off the cavities from the environment but does not extend so far into the cavities that electrically insulates the connector portion of the connector pins. The sealing material is preferably both ultravioletly-curable for rapid curing and heat-curable to cure the material in shadow areas.

6 Claims, 1 Drawing Sheet

SEALING OF CONTACT OPENINGS FOR CONFORMALLY COATED CONNECTORS FOR PRINTED CIRCUIT BOARD ASSEMBLIES

The U.S. Government has a paid-up license in this invention and the right in limited circumstances to require to the patent owner to license others on reasonable terms as provided for by the terms of Contract No. N00024-80-C-7359 awarded by the Navy.

BACKGROUND OF THE INVENTION

This invention is related to electrical connectors and, more particularly, to electrical connectors in which the connector body is conformally coated and the contact tails are sealed to prevent the conformal coating material and other contaminants, such as solder and solder flux, from entering the connector body.

The trend toward greater complexity and miniaturization of printed circuit boards and connectors means that conformal coating is both more important and increasingly more difficult. The closer the line spacing, the more vulnerable the solder connections are to moisture and contaminants, heightening the need for protective coating. At the same time, the close contacts of connectors best suited to these boards are extremely difficult, time consuming and costly to mask properly before boards can be coated. The necessity for conformal coating is well established. Uncoated solder connections are vulnerable to moisture and contaminants which can lead to short circuiting or other malfunction.

Complex boards with closer line spacing present a higher potential for corrosion damage. Tin lead oxide can form on boards subjected to humidity, creating conductive paths between leads. Humidity and DC current also encourage dendritic growth or copper filaments plating out from one lead and growing toward another. The risk of either of these unwanted conducting paths in the connector solder terminations increases the need for protective coating.

Military standard, MIL-STD-275, Printed Wiring for Electronic Equipment, states:

> Printed-wiring assemblies shall be conformally coated . . . . The coating shall be applied to both sides of the cleaned printed-wiring assembly, including the part leads.

To meet requirements for conformal coating, one alternative is to mask the entire connector to prevent coating material from penetrating the contact area during the coating process. An additional coating process is required to comply fully with military standards. Not only is extensive masking costly and slow, it is not 100% reliable. On occasion, some coating material wicks into the connector, interfering with proper insertion of the mating part. This can result in either a permanent loss of electrical connection, or an intermittent loss, which is even more difficult to locate and correct. In either case, the connector must be removed and replaced which is time consuming and labor intensive. Furthermore, there is a risk that damage can occur, potentially leading to scrapping the board at a cost of several thousand dollars.

In the box and post style connectors, and other types of connectors suitable for high density printed circuit board applications, contact tails extend from one side of a connector body, and the opposite side of the connector body is open to receive a mating connector pin. In many applications a conformal coating is desirably employed to coat the entire body of the connector, except for the openings where the mating pins enter the connector body. The conformal coating seals off the connector against moisture and foreign materials.

It is known that the conformal coating material must not enter the connector pin portion, since if it does it may prevent electrical contact between contacts in the body and mating contacts inserted into the connector. U.S. Pat. No. 4,645,278, issued Feb. 24, 1987, entitled "Circuit Panel Connector, Panel System Using the connector, and Method for Making the Panel System," which issued to Harold M. Yevak, Jr. et al, shows the use of a high-temperature-resistant tape of a polyimide material that has a layer of a high-temperature adhesive thereon. The tape is removably secured over the opening to seal off the openings where the mating connector pins are inserted.

In the Yevak, Jr. et al patent, an acrylic material is used for the conformal coating, and a flexible heat-curable, adhesive sealing material, such as a conventional epoxy, or silicone sealer is secured to the bottom of the connector body in the contact tails area. The connector of the Yevak, Jr. et al patent is mounted on a circuit panel and the heat-curable adhesive layer engages the circuit panel. The panel is than subjected to a heat treatment, such as occurs during soldering of the contacts to the circuit panel, and the adhesive layer is cured to adhere the bottom of the connector body to the circuit panel.

The use of epoxy or silicone sealing materials which are heat-curable during the soldering phase often will not seal off the base sufficiently to exclude solder or solder flux from the body of the connector. Moreover, silicone materials tend to prevent many commonly employed conformal coating materials from adhering properly to a coated connector, or associated printed circuit board.

U.S. Pat. No. 3,744,128, issued July 10, 1973, entitled "Process for Making R.F. Shielded Cable Connector Assemblies and the Products Formed Thereby," issued to Aaron Fisher et al, shows the use of a material which contains a thixotropic agent which is dispensed through a pressure gun cartridge into a R.F. shielded cable assembly. Because of the non-sagging nature of this bulk potting material it remains where it is applied. The potting material is heat-curable and very little subsequent flow occurs in the cable assembly.

In the Fisher et al cable assembly, once the cable and connector structure is potted with the flexible potting material, the entire exterior surface of the potting material, and portions of the adjacent connector housing are coated with an electrically conductive material. A supportive protective jacket is then placed over the conductive coating and the coated portion of the connector housing. The Fisher et al cable assembly, however, does not receive mating pins inside the body of the assembly, nor is its exterior conformally coated, as are the connectors of the Yevak, Jr. patent and of the present invention.

BRIEF DESCRIPTION OF THE DRAWINGS

The present invention is described by reference to the drawings in which.

TECHNICAL DESCRIPTION OF THE INVENTION

Figure 1:
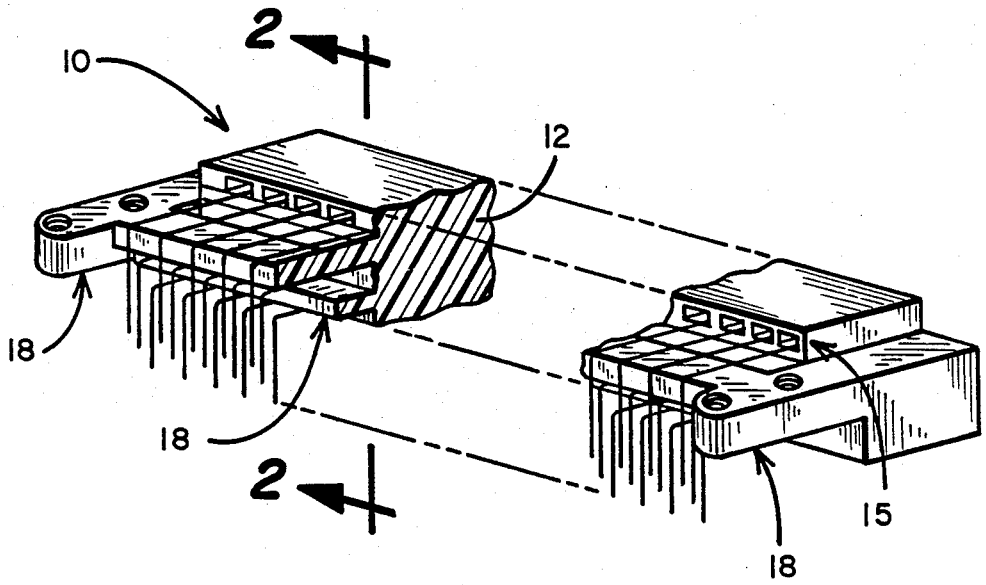
FIG. 1 shows a perspective view of the end sections of a connector that is sealed in accordance with the present invention.
Figure 2:
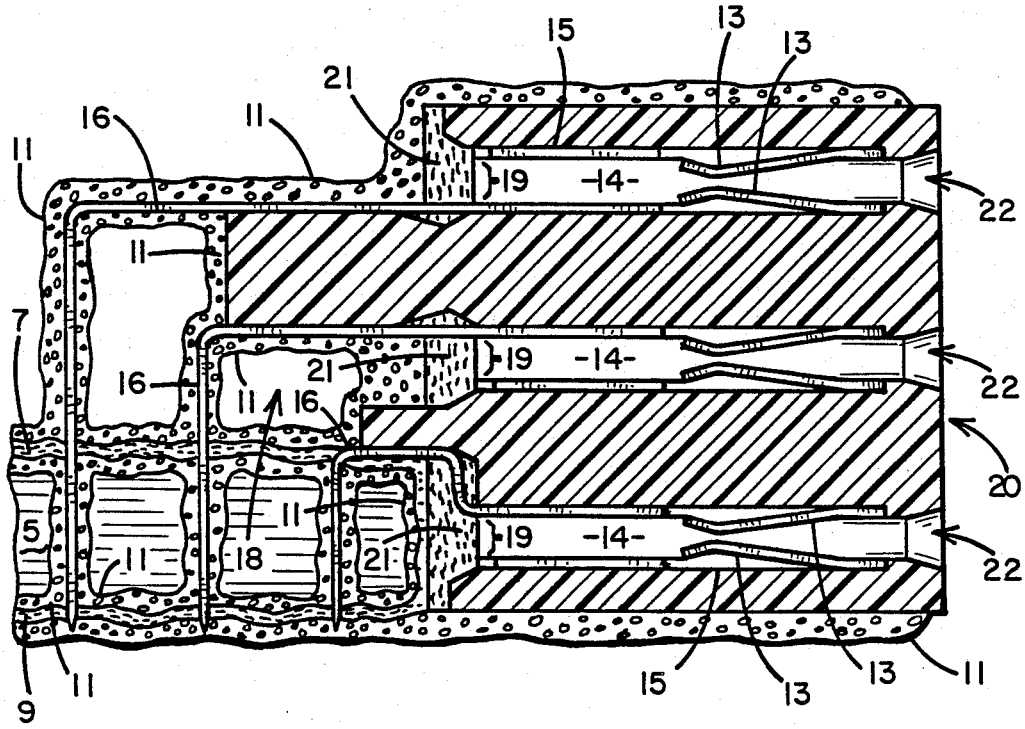
FIG. 2 shows a cross-sectional view of the FIG. 1 connector taken along the lines 2—2 of FIG. 1.

FIGS. 1 and 2 show a post and box style connector representative embodiment of the present invention. Post and box style connectors are desirable where many connections are required, and the insertion force of each connecting section must be minimized. FIG. 1 shows the side portions of a connector 10 which has a housing 12 that encloses a multitude of post type female connector contacts 14. The connector contacts 14 are enclosed in openings 15, which receive mating electrical connector pins (not shown) therein. The connector contacts 14 have contact tails 16 which extend out of the printed circuit board side 18 of the housing 12, and are secured into a printed circuit board 5 usually having several layers 7, 9. The other side 20 of the connector housing has an opening 22 for each of the connector contacts 14 so that mating male plugs may enter into these openings and make electrical contact with the connector wiper sections 13.

Conventional conformal coating material 11, such as an acrylic material, for example, is applied over the connector housing 12 and the printed circuit board to conformally coat them, which coating may be in accordance with the requirements of military standards, such as MIL-STD-275. Post and box style connectors are well adapted to high density circuit card assemblies because of their low insertion force, but they are difficult to conformally coat. Conformal coating of such connectors is currently accomplished by dipping the circuit card assemblies into the conformal coating material. It is very difficult with many existing box connector designs to prevent conformal coating material from penetrating into the contact area, which thereby causes permanent, or intermittent, loss of electrical contact.

Extensive masking is required to prevent this from occurring which is time consuming and labor intensive, and often this masking may result in damage which leads to scraping of entire circuit card assemblies which may be worth thousands of dollars. With such connectors, it is extremely important to be able to completely and effectively seal off the portions of the connector body from which the contact tails emerge from it. Additionally, it is very important to cut down on the amount of time that is required in producing the connector, and especially in reducing the masking requirement. Masking is still required over the openings where the mating connector pins are inserted, but with the present invention masking is no longer needed on the portion of the connector body where the contact tails emerge.

In order to effectively seal the connector for conformal coating, especially under military requirements, a thixotropic material 21 is used to fill the void between the contact tails 16 and the receiving cavities 19, the thixotropic material must not penetrate too deeply into the connector body. This problem is resolved by using a thixotropic material which thins upon dispensing through a small nozzle (not shown), and quickly reverts to a higher, less flowable, higher viscosity material after application. The preferred material of the present invention is ultravioletly curable so that the material will be cured almost immediately when exposed to ultraviolet light before any additional flow occurs. In the event that there are shadow areas where the material is not cured by the ultraviolet source, a subsequent thermal cure may be utilized to finish the cure in these areas.

Curing may be accomplished by transporting the connectors along a conveyor through a dispensing stage followed by a curing stage. The first stage may consist of a set of dispensing head nozzles (not shown) that are positioned to direct the sealing material toward the cavities 19. The nozzle heads may then dispense material into these cavities at a predetermined rate and the components then may move them through an ultraviolet chamber for curing. The entire sealing process with the preferred material should require less than fifteen seconds for dispensing and UV curing. A subsequent thermal "shadow cure" may be used to complete curing in a few minutes for areas where the UV cure was ineffective.

Ultraviolet cure offers several important advantages for sealing connectors. There are no solvents to interfere with worker safety or with other manufacturing processes. State-of-the-art UV cure systems are commercially viable, safe and fast. The cure is effected before the material can flow into the connector body contact area. Futhermore, unlike many heat cured materials, this material does not reduce in viscosity and flowout during the cure cycle.

The connector is transported along a conveyor past a set of pressure-time disperse heads with nozzles (not shown) for applying material to the contact tail end cavities 19. The components then move immediately into an ultraviolet chamber for curing. The system can be configured to eliminate transfer between conveyors for dispensing and curing. The final operation of the sealing system is testing the connector to insure it is completely sealed. Several testing options are available, including gas flow and optical fibers. Microprocessor control may be used to make it possible to identify precisely any defective seals.

With this combination of sealing material and a connector that can be sealed and tested, unpredictable rework and scrap may be decreased substantially, and greater control can be exercised over conformal coating costs. A further benefit is that sealed connector stops flux from wicking into the connector during subsequent soldering operations, preventing other potential problems and further reducing unpredictability.

The preferred material that is employed for sealing of the printed circuit board side of the connector, in accordance with the present invention, is thixotropic and ultraviolet and heat curable. A suitable material is a modified methacrylated/acrylated urethane, one-component, 100% solids, material sold under the trademark UVEXS 605A by Dow Corning Company. This material was developed for this application pursuant to directions of the inventors of this invention. Other thixotropic materials suitable for the particular application may be alternately employed. In military applications, flame, fungus and moisture resistant ingredients are also preferably added.

The sealing material has good insulation resistance before and after moisture insulation resistance testing, which is similar to the conformal coating. It is a compatible dielectric strength and causes no disruptive discharge during testing. To help provide good moisture protection, the material has good adhesion, and this should be a minimum of 6.0 pounds per inch width when bonded to the connector material. The material should also have a similar coefficient of linear thermal expansion to the printed circuit board to maintain adhesion and avoid stress.

One of the key considerations in using this sealing material is ease of application. The two important factors here are viscosity and cure. The thixotropic sealing material is easily dispensed and spreads to fill the voids between the contact end tails and their individual cavities, and then returns to its original state before it penetrates too far into the cavity to insulate the connector contacts 14 from the mating insertable male pins with the connector wiper sections 13.

To perform compatibly with other materials and processes related to the circuit card assembly, the sealing material has specific physical characteristics. It is noncorrosive, even under humidity testing; solvent resistant so it will not be affected by solvents used elsewhere in processing; fungus resistant and either self-extinguishing or nonburning in flammability tests.

Although the present invention has been disclosed in connection with one particular type of connector, it is not limited thereto and may be used in other applications which will be obvious to those skilled in the art. The thixotropic sealing material of the preferred embodiment is only one example of a suitable thixotropic, and preferably UV curable material.

We claim:

1. In an electrical connector having a housing, a connecting portion and at least one contact member in a cavity in said housing comprising a connecting contact tail that emerges from said housing and a conformal coating over at least a portion of said housing and said contact tails, the improvement comprising a thixotropic, curable sealing material that is applied under sufficient pressure so that the viscosity of said thixotropic material is lowered so that it flows into said cavities far enough to seal-off said cavities while said pressure is applied and before the conformal coating is applied, but not so far that said thixotropic material electrically insulates said connecting portion, wherein said thixotropic material is curable upon the release of said pressure and while so located in said cavities.

2. A connector as claimed in claim 1 wherein said thixotropic material is ultravioletly curable.

3. A connector as claimed in claim 2 wherein said thixotropic material is heat curable.

4. A connector as claimed in claim 1 wherein said connector is conformally coated after said thixotropic material is cured.

5. A connector as claimed in claim 4 wherein said thixotropic material is ultravioletly curable.

6. A connector as claimed in claim 5 wherein said thixotropic material is heat curable.

* * * * *